US005437591A

United States Patent [19]

Chen

[11] Patent Number: 5,437,591

[45] Date of Patent: Aug. 1, 1995

[54] CHEST EXPANDER

[76] Inventor: Chih-Liang Chen, No. 10, Lane 1431, Kuanghsin Rd., Peteh Hsiang, Taoyuan Hsien, Taiwan

[21] Appl. No.: 330,447

[22] Filed: Oct. 28, 1994

[51] Int. Cl.[6] ..... A63B 21/045; A63B 21/018

[52] U.S. Cl. ..... 482/127; 482/126; 482/120; 482/118

[58] Field of Search ..... 482/127, 126, 120, 118, 482/121, 122, 114, 115

[56] References Cited

U.S. PATENT DOCUMENTS

| | | | |
|---|---|---|---|
| 1,867,642 | 7/1932 | Woods | 482/127 |
| 2,951,702 | 9/1960 | Goodwin | 482/127 |
| 3,596,907 | 8/1971 | Brighton | 482/127 |
| 4,114,875 | 9/1978 | Deluty | 482/127 |
| 4,135,714 | 1/1979 | Hughes | 482/127 |
| 4,174,832 | 11/1979 | Thompson | 482/127 |
| 4,328,965 | 5/1982 | Hatfield | 482/127 |
| 5,147,264 | 9/1992 | Braathen | 482/120 |

*Primary Examiner*—Lynne A. Reichard
*Attorney, Agent, or Firm*—Poms, Smith, Lande & Rose

[57] ABSTRACT

A chest expander includes a first handle having two distal ends, a substantially U-shaped tubular housing including a first line and a second line extended from two limb ends thereof and connected to two distal ends of the first handle, a second handle connected between the two limbs of the U-shaped tubular housing, and a load adjusting mechanism being received in one corner of the U-shaped tubular housing allowing a user to adjust the load of the chest expander. The two handles of the chest expander are manually extended and retracted repeatedly via the two lines.

2 Claims, 4 Drawing Sheets

CHEST EXPANDER

BACKGROUND OF THE INVENTION

1. Field of the Invention

The present invention relates to a chest expander especially one whose load is more easily adjustable than a conventional chest expander.

2. Description of the Prior Art

A conventional chest expander normally includes two handles each of which is connected to a frame. A plurality of springs are connected between the two frames and are allowed to be removed individually from the frames. Therefore, when a user wants to increase or decrease the load, i.e., the springs, he/she has to spend time to add on or take off one or more springs, thus resulting in inconvenience. Moreover, the conventional chest expander occupies quite a lot space because the springs are not foldable. Furthermore, the user has to find a case or the like to store the removed springs, thus causing more inconvenience.

The present invention has arisen to mitigate and/or obviate the afore-described disadvantages of the conventional chest expander.

SUMMARY OF THE INVENTION

The primary objective of the present invention is to provide an improved chest expander the load of which is easily adjusted and which occupies less space than a conventional chest expander.

In accordance with one aspect of the invention, there is provided a chest expander comprising a first handle having two distal ends, a substantially U-shaped tubular housing including a first line and a second line extended from two limb ends thereof and connected to two distal ends of the first handle, a second handle connected between the two limbs of the U-shaped tubular housing, a load adjusting mechanism being received in one corner of the U-shaped tubular housing and including a positioning plate fixed in the housing, a unidirectional bearing including an outer wheel, an inner wheel, and a shaft firmly connected to and extending from the inner wheel, a pulley which has two tracks for the two lines to be wound, a torsional spring engaged between an inner periphery of the pulley and the shaft of the unidirectional bearing, a rotatable means being partially received in the corner of the housing, a frictional ring being retained between the outer wheel of the unidirectional bearing and the rotatable means; whereby the rotatable means is rotated to urge or release the frictional ring thereby increasing or decreasing a resistance between the outer wheel of the unidirectional bearing and the frictional ring, whereby when the pulley is rotated in a first direction via the two lines by manually extending the two handles, the shaft of the unidirectional bearing is driven to rotate in a first direction via the torsional spring which in turn drives the inner wheel and the outer wheel to rotate in the first direction, when the two handles are retracted, the two lines are retracted around the two tracks of the pulley by a tension from the torsional spring, causing the shaft and the inner wheel of the unidirectional bearing to rotate in a second direction counter to the first direction, meanwhile the outer wheel of the unidirectional bearing does not rotate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
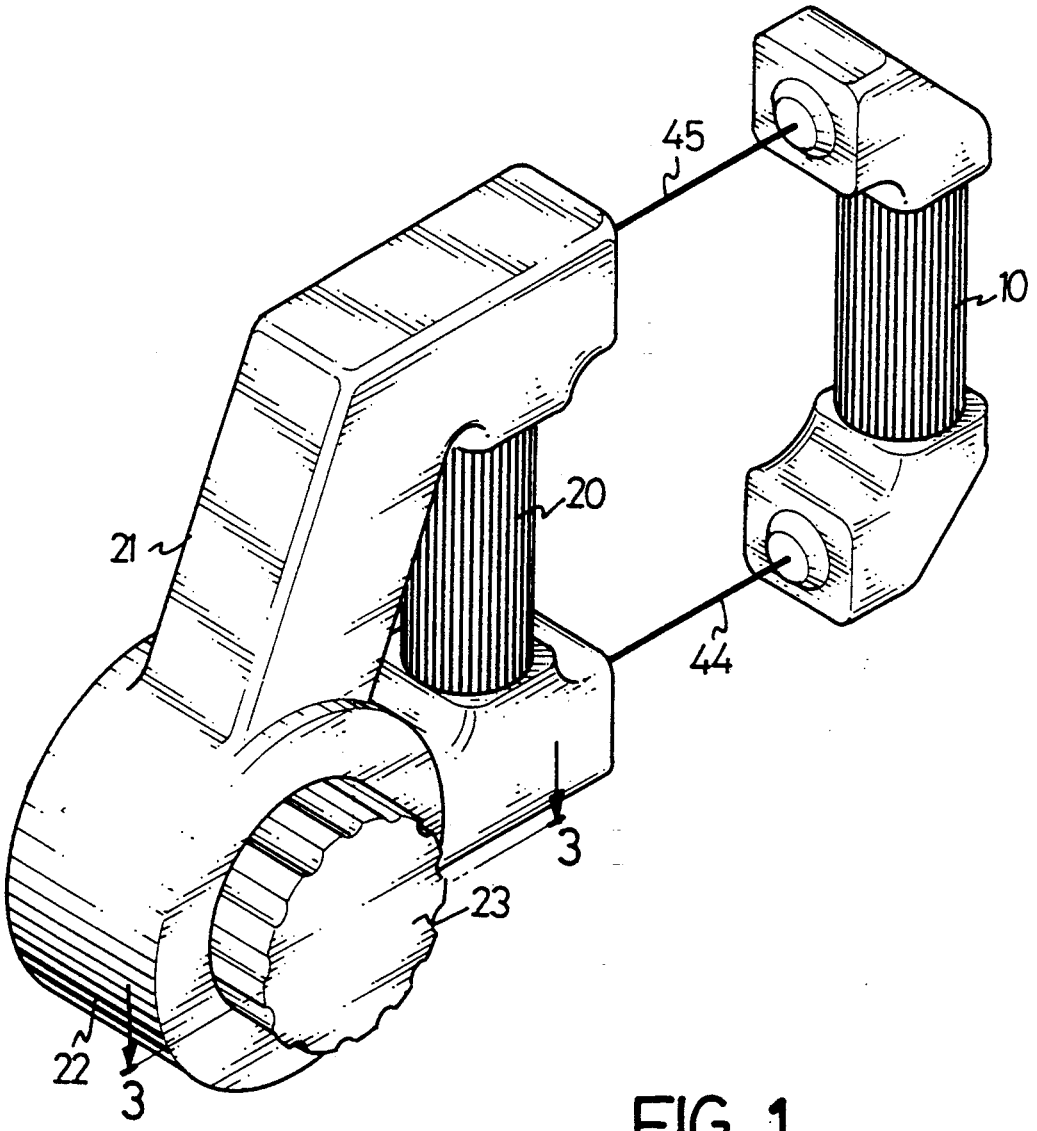
FIG. 1 is a perspective view of a chest expander in accordance with the present invention, where a load adjusting mechanism is shown at a left lower corner of the figure.

Referring to FIG. 1, a chest expander in accordance with the present invention comprises a first handle 10 having two distal ends, a substantially U-shaped tubular housing 21 including a first line 44 and a second line 45 extended from two limb ends thereof and connected to two distal ends of the first handle 10. A second handle connected between the two limbs of the U-shaped tubular housing 21 allows a user to hold thereon. A corner 22 of the U-shaped tubular housing 21 is formed as circular shape disposed with a load adjusting mechanism. A cap 23 (or a knob) is partially received in the corner 22 of the housing 21 and is rotatable to adjust a load of the chest expander. A user operates the chest expander by holding the two handles 10 and 20, pulling and retracting the two lines 44 and 45 repeatedly.

Figure 2:
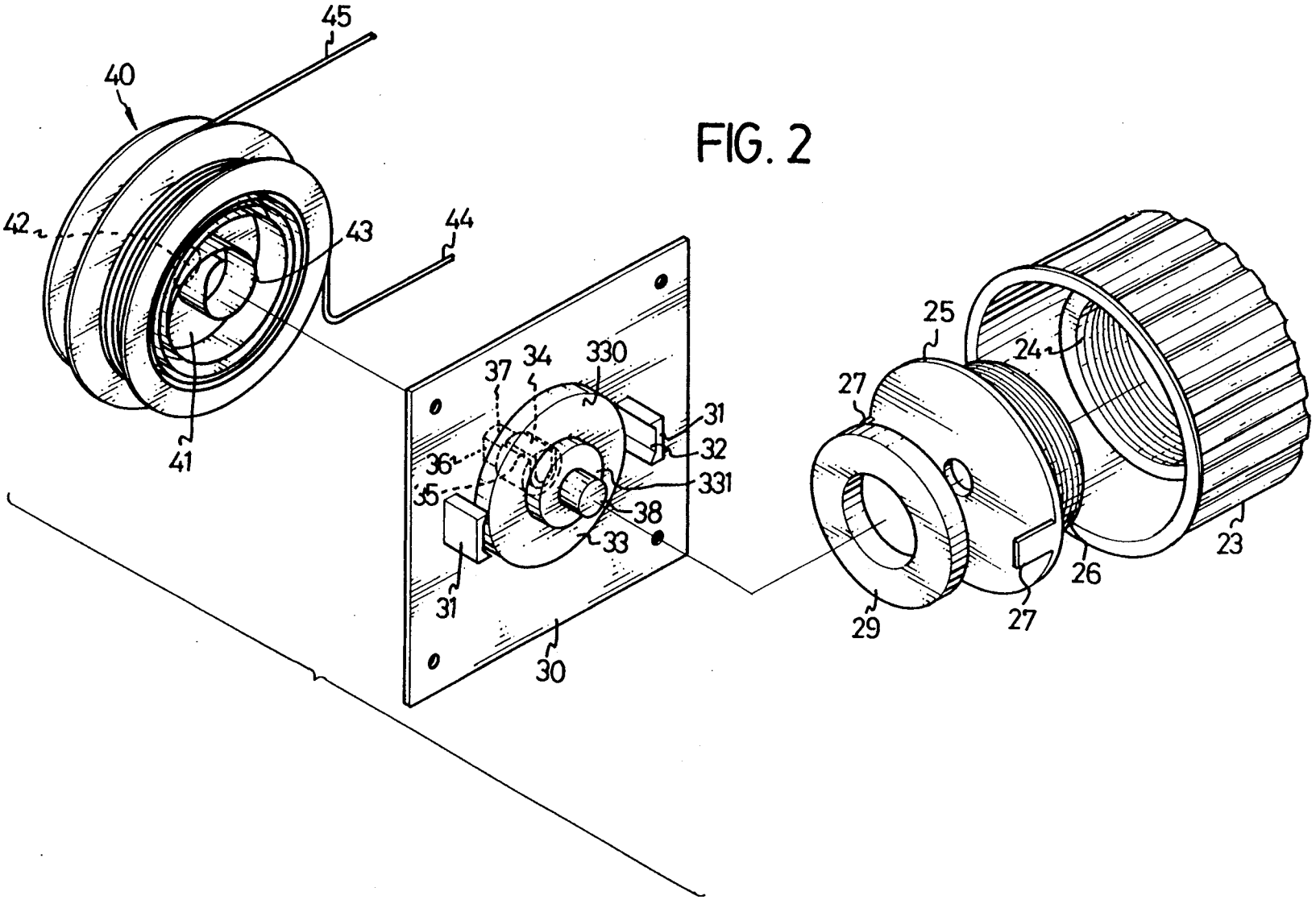
FIG. 2 is an exploded view of the load adjusting mechanism of FIG. 1.

Referring to FIG. 2, the load adjusting mechanism comprises the cap 23 which has an innerly threaded hub 24 extending from an inner surface thereof and a flange 231 extending from a periphery thereof, a movable plate 25 having an outerly threaded hub 26 extending from a first surface thereof for engaging to the innerly threaded hub 24 of the cap 23 and two tabs 27 extending from a second surface opposite to the first surface of the movable plate 25. A positioning plate 30 is fixed in the circular corner 22 of the U-shaped tubular housing 21 and includes two protrusions 31 projecting therefrom. Each of the protrusions 31 defines a guiding passage 32 for slidably receiving a corresponding one of the tabs 27 of the movable plate 25. A unidirectional bearing 33 is positioned on the positioning plate 30 and includes an outer wheel 330, an inner wheel 331 enclosed by the outer wheel 330, and a shaft 38 engaged to and extended from a center of the inner wheel 331. A first rod 34 extends from the inner wheel 331 to a direction opposite to the projection direction of the two protrusions 31. A U-shaped groove 35 is downwardly defined from a top surface of the first rod 34. A second rod 37 extends from a portion enclosed by the U-shaped groove 35 of the top surface of the first rod 34. The second rod 37 defines a cutout 36 along a periphery thereof. A frictional ring 29 is retained between the two tabs 27, the second surface of the plate 25 and the outer wheel 330 of the unidirectional bearing 33 for providing resistance when the outer wheel 330 of the bearing 33 is rotated.

A dual-track pulley 40 includes a first track for winding the first line 44 and a second track for winding the second line 45, a board 41 firmly connected to one opening of the pulley 40, a D-shaped hole 42 being defined in a center of the board 41 and firmly receiving the second rod 37 extended from the bearing 33. A torsional spring 43 made of spiral metal leaf has an outer portion fixed to an inner periphery of the pulley 40 and has a central leaf portion thereof engaged in the U-shaped groove 35 of the first rod 34 of the bearing 33. An assembled cross-sectional view of the parts in FIG. 2 is shown in FIG. 3, where the two lines 44 and 45 are omitted for clarification.

Figure 3:
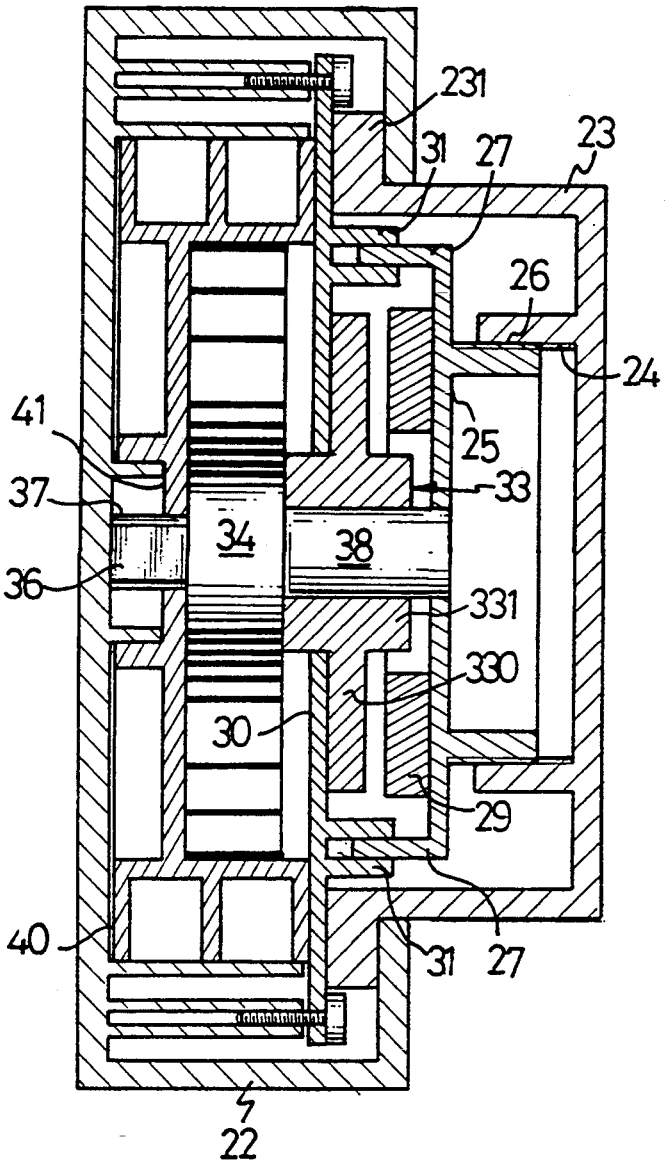
FIG. 3 is a cross-sectional view of the load adjusting mechanism in FIG. 1.

Referring to FIG. 3, the pulley 40 rotates by manually pulling the two lines 44, 45 (see FIGS. 1 and 2) from the handles 10 and 20, thus driving the second rod 37, the inner wheel 331, and the outer wheel 330, meanwhile the torsional spring 43 is deformed and results in a tension. The two lines 44 and 45 retract back coiling around the pulley 40 due to the tension of the torsional spring 43 when the two handles 10 and 20 (see FIG. 1) are retracted. A user repeatedly pulls/releases the two handles 10 and 20 thus performing exercise. When the user operates the chest expander of the present invention, he/she works on a load (or resistance) primarily comprising the tension from the torsional spring 43 and a resistance between the outer wheel 330 of the bearing 33 and the ring 29. The flange 231 of the cap 23 is rotatably retained between the positioning plate 30 and the circular corner 22 of the housing 21, therefore the cap 23 does not have axial displacement when it is rotated. The tension from the torsional spring 43 is constant while the resistance between the outer wheel 330 of the bearing 33 and the frictional ring 29 is adjustable by properly rotating the cap 23. When the cap 23 is rotatable with respect to the plate 25, since the two tabs 27 of the plate 25 are limited in the two passages 32 of the two protrusions 31, the two tabs 27 of the plate 25 slide along the two passages 32 thus the plate 25 moves toward or off the bearing 33 when the cap 23 is manually rotated. More specifically, when the cap 23 is manually rotated in a clockwise direction, the plate 25 is moved off the bearing 33, and the ring 29 between the plate 25 and the outer wheel 330 of the bearing 33 does not compress the outer wheel 330 of the bearing 33 as shown in this FIG. 3. When the cap 23 is manually rotated in a counter-clockwise direction, the plate 25 is moved toward the bearing 33 thus forcing the ring 29 to compress the outer wheel 330 of the bearing 33. As mentioned, a resistance resulted from a friction between the ring 29 and the outer wheel 330 of the bearing 33 is adjustable by manually operating the cap 23. More specifically, the resistance is increased by rotating the cap 23 in counter-clockwise direction. It should be noted that the inner wheel 331 is firmly engaged to the outer wheel 330 when the inner wheel 331 is rotated in a direction due to a pull by the two lines 44 and 45, while the inner wheel 331 is rotatable with respect to the outer wheel 330 when the torsional spring 43 retracts from a tensional status to its original status.

Figure 4:
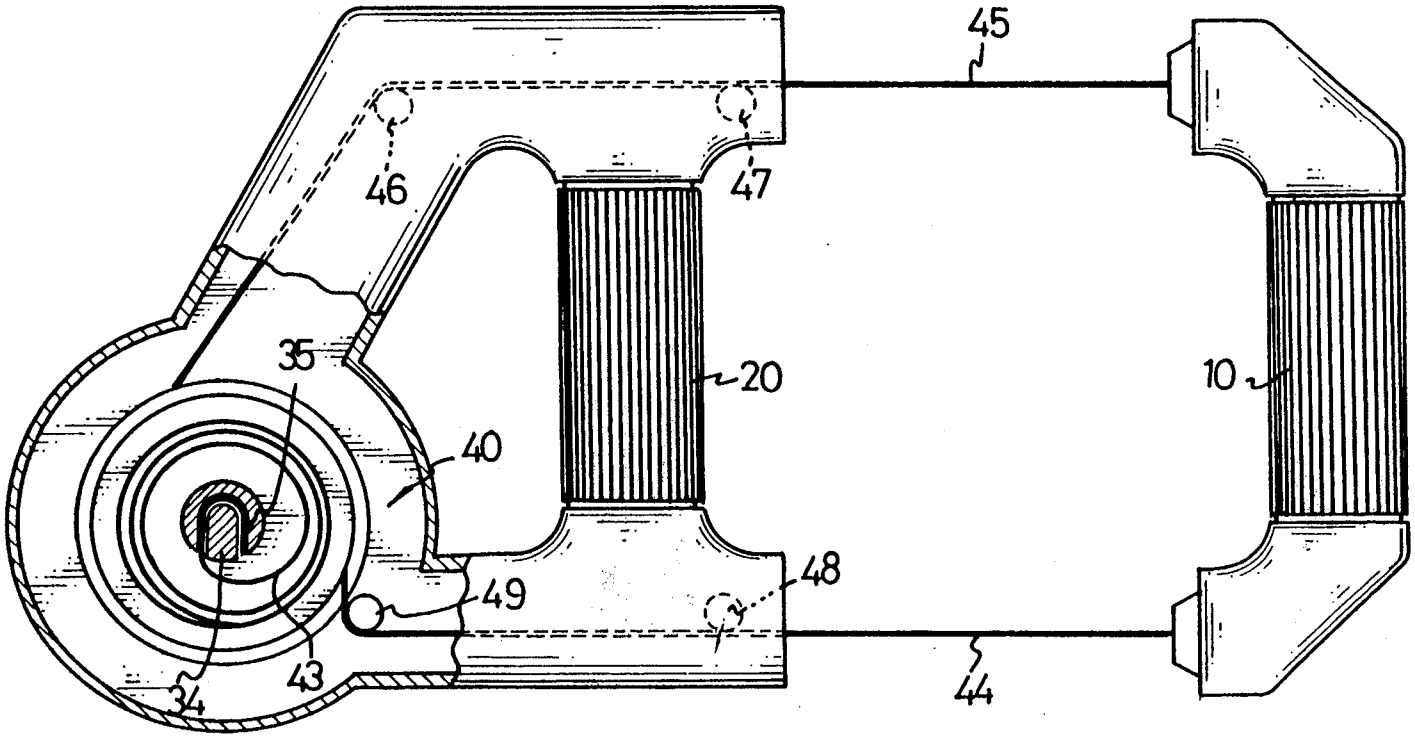
FIG. 4 is another perspective view of the chest expander, with some portions being removed for illustrating a torque spring in the load adjusting mechanism.

Referring to FIG. 4, four positioning pulleys 46, 47, 48, and 49 are fixed in the U-shaped tubular housing 21 for retaining the two lines 44 and 45 in track when they are pulled and retracted. Therefore, when a user wants to adjust the load of the chest expander, he/she merely rotates the cap 23 (see FIG. 1). The chest expander of the present invention provides a very conventional way for adjusting loading thereof and occupies relatively small space, therefore it is useful in practice.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A chest expander comprising a first handle having two distal ends;

a substantially U-shaped tubular housing including a first line and a second line extended from two limb ends thereof and connected to two distal ends of the first handle;

a second handle connected between the two limbs of the U-shaped tubular housing;

a load adjusting mechanism received in one corner of the U-shaped tubular housing and including a positioning plate fixed in the housing, a unidirectional bearing including an outer wheel, an inner wheel, and a shaft firmly connected to and extending from the inner wheel, a pulley which has two tracks for the two lines to be wound therearound, a torsional spring engaged between an inner periphery of the pulley and the shaft of the unidirectional bearing, a rotatable means partially received in the corner of the housing, a frictional ring retained between the outer wheel of the unidirectional bearing and the rotatable means;

whereby the rotatable means is rotated to urge or release the frictional ring thereby increasing or decreasing a resistance between the outer wheel of the unidirectional bearing and the frictional ring, whereby when the pulley is rotated in a first direction via the two lines by manually extending the two handles, the shaft of the unidirectional bearing is driven to rotate in a first direction via the torsional spring which in turn drives the inner wheel and the outer wheel to rotate in the first direction, when the two handles are retracted, the two lines are retracted around the two tracks of the pulley by a tension from the torsional spring, causing the shaft and the inner wheel of the unidirectional bearing to rotate in a second direction counter to the first direction, while the outer wheel of the unidirectional bearing does not rotate.

2. A chest expander as claimed in claim 1, wherein the rotatable means comprises a cap which has an innerly threaded hub extending from an inner surface thereof and a flange extending from a periphery thereof and a movable plate having an outerly threaded hub extending from a first surface thereof for engaging to the innerly threaded hub of the cap and two tabs extending from a second surface opposite to the first surface of the movable plate, and the positioning plate includes two protrusions projecting therefrom, each of the protrusions defining a guiding passage for slidably receiving a corresponding one of the tabs of the movable plate.

* * * * *